United States Patent [19]

Adams et al.

[11] 4,063,996

[45] Dec. 20, 1977

[54] WATER REMOVAL FROM FIBERBOARD

[75] Inventors: George R. Adams, Lancaster; William T. Meisenbach, Columbia, both of Pa.

[73] Assignee: Armstrong Cork Company, Lancaster, Pa.

[21] Appl. No.: 752,437

[22] Filed: Dec. 20, 1976

Related U.S. Application Data

[63] Continuation of Ser. No. 609,946, Sept. 3, 1975, abandoned.

[51] Int. Cl.[2] ..... D21F 1/00

[52] U.S. Cl. ..... 162/210; 162/314; 162/364

[58] Field of Search ..... 162/205, 210, 203, 301, 162/305, 364, 313, 314

[56] References Cited

U.S. PATENT DOCUMENTS

| | | | |
|---|---|---|---|
| 2,893,486 | 7/1959 | Marti | 162/364 |
| 3,533,906 | 10/1970 | Reiniger | 162/225 |
| 3,565,757 | 2/1971 | Jordansson | 162/203 |

*Primary Examiner*—Robert L. Lindsay, Jr.
*Assistant Examiner*—George C. Yeung

[57] ABSTRACT

A fibrous board is formed by conventional water laid techniques such as the utilization of a Fourdrinier machine. After the board has formed and has been consolidated, it is subjected to a vacuum action to remove additional water from the wet board structure just prior to the time the wet board structure moves into an oven where final board drying is carried out.

3 Claims, 2 Drawing Figures

WATER REMOVAL FROM FIBERBOARD

CROSS-REFERENCE TO RELATED APPLICATION

This is a continuation, of application Ser. No. 609,946, filed Sept. 3, 1975 now abandoned.

BACKGROUND OF THE INVENTION

1. Field of the Invention

The invention is directed to a wet laid board forming technique and, more particularly, to a supplemental water removal step in an otherwise conventional board forming process.

2. Description of the Prior Art

U.S. Pat. No. 3,056,718 shows the basic apparatus which has been improved upon by the invention herein. The board product is formed on a conventional Fourdrinier and then subjected to a suction box 14 to remove water from the board structure prior to the press section (rolls 16 and 20). The board is then consolidated through the use of pressure rolls 16 and 20.

U.S. Pat. No. 3,066,068 is directed to a conventional Fourdrinier machine and the vacuum means which is utilized to remove excess water from the board on the Fourdrinier wire.

U.S. Pat. Nos. 2,937,701, 2,938,582, and 2,992,963 are directed to conventional cylinder forming machines which are utilized to form a water laid product. These patents teach an alternative to the Fourdrinier structure for the forming of a board product from a fibrous slurry.

SUMMARY OF THE INVENTION

A board product is formed on a conventional water laid forming apparatus such as a conventional Fourdrinier machine. The formed board, in a very wet non-self-supporting state, is moved to a press structure which consolidates the board and further removes water from the board. Normally, the board would now pass to an oven for the final drying of the board so that it will be relatively dry and self-supporting. The improvement herein involves the placing of an additional vacuum suction boxes after the press structure and adjacent to the board to further withdraw liquid from the board to lessen the amount of water which must be evaporated from the board at the oven.

DESCRIPTION OF THE PREFERRED EMBODIMENTS

Figure 1:
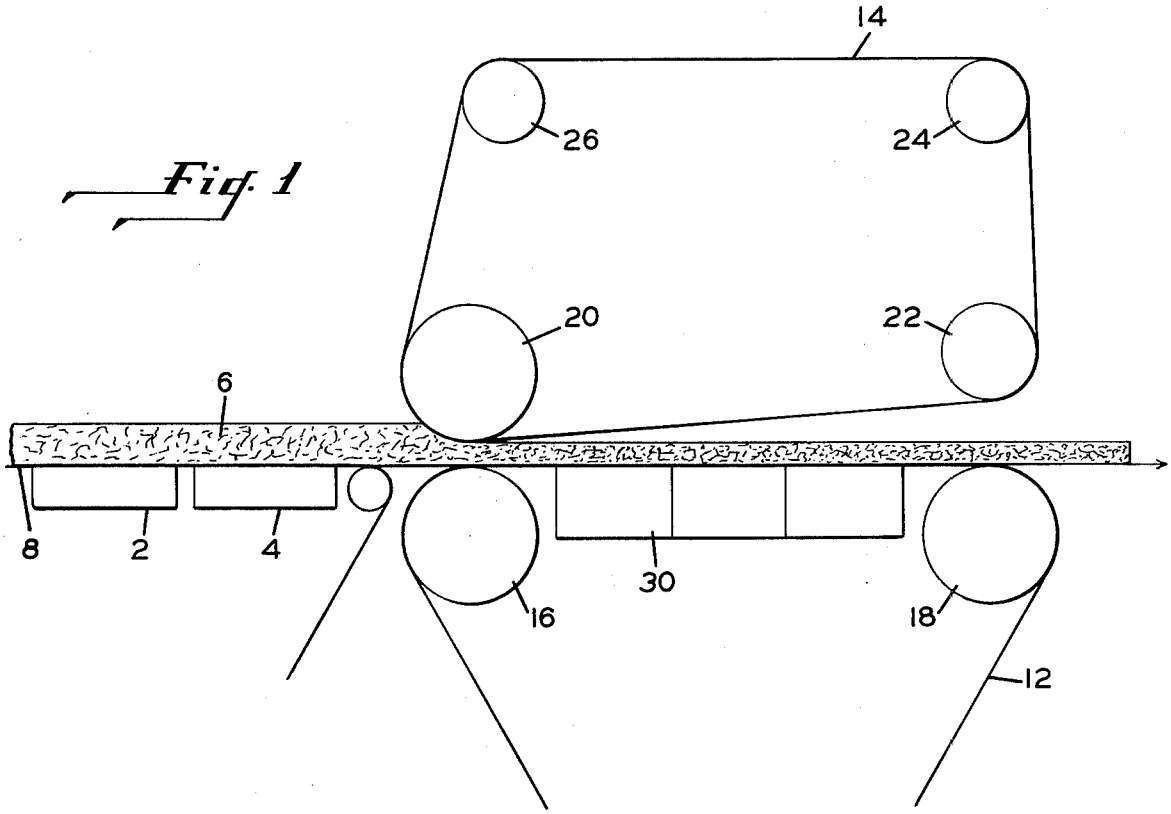
FIG. 1 is a schematic view of the board forming structure herein utilizing a Fourdrinier board forming structure.

The invention herein is being utilized to form a board product such as that disclosed in U.S. Pat. No. 2,995,198. Here an acoustical board product is being formed and is a water laid product formed on a conventional paper forming wire which is part of a Fourdrinier.

The product being formed, such as the product of U.S. Pat. No. 2,995,198, will be formed very much similar to the forming technique disclosed in U.S. Pat. No. 3,056,718. Generally, the product will be formed in a conventional paper making apparatus such as the Fourdrinier-like element 10 of the above-mentioned patent. A slurry of the fibers disclosed in U.S. Pat. No. 2,995,198, will be delivered to the forming machine 10 and laid up on the conventional Fourdrinier forming wire. In the forming machine a certain amount of the water will be permitted to drain from the fibers laid up on the forming wire. In addition, vacuum means 2 and 4 will withdraw water from the fiberboard 6 resting on the forming fabric or wire 8. The vacuum means will be conventional in the art and similar to the vacuum means 14 of U.S. Pat. No. 3,056,718. At this point, the forming wire 8 with the partially dewatered fiberboard 6 thereon will move to a consolidating roll structure 10 which is very similar to the consolidated roll structure 16 and 20 of U.S. Pat. No. 3,056,718.

The consolidating roll structure 10 is composed of a bottom wire 12 and a top wire 14. The bottom wire 12 is supported on two solid rolls 16 and 18 and the bottom wire 12 carries the partially dewatered fiberboard 6. Forming wire 8 and bottom wire 12 can be one continuous wire. The top wire 14 is carried by rolls 20, 22, 24, and 26. Roll 20 is deposed opposite roll 16 and it is the nip of these two rolls which actually does the pressing and consolidating of the partially dewatered board 6. Roll 20 is a vacuum roll in that it is a perforated roll having an open interior in which a vacuum is pulled. Consequently, a certain amount of water will be withdrawn from the dewatered board during the consolidating operation performed between rolls 16 and 20. Rolls 22, 24 and 26 simply support endless top wire 14 so that it may move in an endless path around roll 20. In U.S. Pat. No. 3,056,718, both rolls 20 coact with both rolls 16 to consolidate the sheet. In the apparatus herein, only rolls 16 and 20 herein consolidate the partially dewatered board 6 and no consolidation of the board is carried out between rolls 18 and 22.

Between rolls 16 and 20, the board is consolidated or reduced in thickness by the pressing action of rolls 16 and 20. The thickness of the sheet is reduced in approximately one half by the rolls 16 and 20. That is, the thickness of the sheet prior to rolls 16 and 20 is approximately twice that of the thickness of the sheet as it leaves rolls 16 and 20. At rolls 16 and 20, the sheet will be densified due to the fact that it is being reduced in thickness or consolidated, and rolls 16 and 20 usually give about a 40 to 120 percent densification increase in the sheet. Normally a typical sheet, prior to rolls 16 and 20, is approximately 1.5 inches (3.8 cm) thick and has a density of 0.47 pounds per board foot. After the sheet passes through rolls 16 and 20, it is 0.7 inches (1.8 cm) thick and has a density of about 1.0 pounds per board foot.

Figure 2:
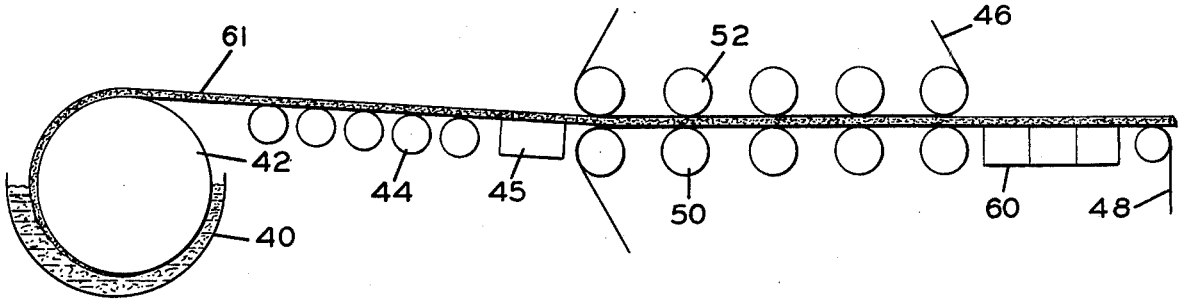
FIG. 2 is a schematic view of a board forming structure utilizing the invention herein involving a vacuum cylinder board forming structure.

In FIG. 2 there is shown a second method of forming and consolidating a board. A vat 40 contains a fiber slurry which is very similar to the fiber slurry which is placed upon the conventional Fourdrinier forming machine. In the vat 40 a vacuum cylinder 42 is positioned. A board product is formed on the outer surface of vacuum cylinder 42 in the same manner as that set forth in U.S. Pat. No. 2,937,701. The formed fiberboard product 6' is supported by a plurality of rollers 44. It is also possible although not often done, to use a conventional vacuum means 45 to further pull water from the fiberboard. The fiberboard then passes to a pressing section which also has a bottom wire 48 and a top wire 46. Here a plurality of rolls engage the partially dewatered board product to consolidate the board product. In FIG. 2, five solid rollers 50 support bottom wire 48. Positioned above rollers 50 are vacuum rolls 52 which engage the top press wire. The partially dewatered board 6' is held between the top and bottom press wires and is pressed and consolidated by the five sets of rolls 50 and 52. These rolls act upon the board 6' to further remove water from the board through brief vacuum action and the roll pressure. Prior to entering the pressing section, another typical board has a thickness of about 1.18 inches (3.0 cm) and a density of 0.72 pounds per board foot. As the board leaves the pressing section, it has a thickness of about 0.61 inches (1.6 cm) and a density of about 1.4 pounds per board foot.

The product, as it leaves the consolidating structure of FIG. 1, will have about 70% water therein. The board, as it leaves the pressing section of FIG. 2, will also have about 70% water therein. Conventionally, as shown in U.S. Pat. No. 3,056,718, the board would be cut to size and fed to an oven wherein heat would lower the water content to about 2%. Obviously, a substantial amount of heat will be utilized to remove this amount of water from the fiberboard.

The improvement over the prior art, or the invention herein, is the provision of a high level vacuum means after the pressing or consolidating section of conventional board forming machines. Up to this time in the art, no vacuum treatment of fiberboards was carried out after the pressing or consolidating actions. Due to the 40 to 120% increased densification in the board, it was felt that the density of the board was such that a vacuum placed on one side of the board would not be able to reasonably pull a quantity of air through the dense board to draw water out of the board. Also, at this point, the board had sufficient strength for handling purposes so that it was thus very easy to pass the board on roller conveyors to an oven which would then readily remove the excess water from the board. In FIG. 1, a conventional high level vacuum box 30 is positioned after final consolidating rolls 16 and 20. In FIG. 2, a conventional high level vacuum box 60 is positioned after pressing rolls 50 and 52. Usually, the vacuum box would be made with a plurality of segments that extend transverse along the bottom press wire. Each of the segments of the vacuum box would be connected to a vacuum source and each would pull an independent vacuum. Any of the conventional high level vacuum boxes used in the water laid forming apparatus art can be utilized. One specific structure that has been utilized is the vacuum box structure sold by Edge Wallboard Company. Another box that can be used is the Evans Rotabelt. As was indicated above, the vacuum box extends the full width of the bottom press wire carrying the partially dewatered and consolidated board. This box would have a plurality of segments, each of which are about 12–18 inches long and the width of the board 6 or 6'. In each of these segments, a vacuum of as low as 10 and preferably between 15 to 20 inches of mercury is pulled. The number of segments utilized is manipulated to maintain a high vacuum level and generally are operated such that the board will have a two- to five-second dwell time over the vacuum box assembly. That means that the board, as it passes over the vacuum box, will be subjected to the 15 to 20 inches of mercury vacuum for approximately two to five seconds. During this time, the water load of the board is reduced by 1/5–¼ of the initial water load. This reduction in water content of the board will provide approximately a 20% saving in the amount of heat needed to dry the board in the oven.

It has also been noted that it has been possible to form a less dense board when one utilizes the subsequent vacuum action above described.

In the conventional board forming technique wherein the pressing or consolidation is carried out and the board moves to the oven, the board normally has a density of 1.0 to 1.4 pounds per board foot so that the board will have sufficient strength and density to stay together as it moves towards the oven. With the use of the subsequent vacuum action above described, it is now possible to press or consolidate the board less than what one would normally do and then subject the board to a further dewatering operation by means of the vacuum action above described. There is now formed a board product which has a density of 0.9 pounds per board foot. However, a board with this density, after it has passed through the vacuum operation, will have sufficient wet-web strength to move towards the oven. A board of this density (0.7 to 0.9 pounds per board foot), not subjected to the vacuum operation in a conventional board forming operation, would probably break up as it moves towards the oven structure.

Finally, it has been found that it is possible to reduce the amount of kraft pulp and eliminate other wet-web strength additives in the board product when additional vacuum action is applied. The kraft pulp is utilized to give the board wet-web strength, particularly when the board is moving from the pressing and/or consolidation section through to the oven and through the initial stages of the oven. If the kraft content were reduced to 80% of its original level, the board would not have sufficient strength to stay together as it passed towards the oven. However, through the use of the additional vacuum action above described, it is possible now to lower the kraft content to 25% of its original level and find that the board will now have sufficient strength to move to and through the initial stages of the oven without breaking up. An additional benefit in a lowered kraft content is improved fire resistance and dimensional stability of the product.

Consequently, through the utilization of the additional vacuum action after the pressing and/or consolidation action on the board, it is possible to greatly reduce the amount of energy needed to dry the board, reduce the density of the board formed, and eliminate some of the strengthening material added to the board to give it wet-web strength just prior to and during initial oven drying.

What is claimed is:

1. In a process for producing a fiberboard structure by a water laid process characterized in that the fiberboard has two parallel surfaces, the steps of forming the fiberboard comprises:

a. forming an aqueous slurry of at least one fibrous material, b. felting a fibrous board of the slurry on a conventional water laid forming machine, c. partially dewatering the fibrous board by drainage and/or a first vacuum action to form a sheet of approximately 1.5 inches thickness, d. the improvement comprising consolidating the board by a pressure operation to further dewater the product and to reduce its thickness about one half and decrease its porosity due to a 40 to 120% densification, said consolidated board having a density of less than 1 pound per board foot and having a wet strength which makes the board non-self-supporting, e. then further subjecting the fibrous board to a high level vacuum action after the consolidation step to further dewater the board, said high level vacuum action being greater than the vacuum action of the above-said first vacuum action and this further high level vacuum action dewatering the board until it now has sufficient wet strength to support itself.

2. The process for providing a fiberboard structure as set forth in claim 1 wherein the last-mentioned vacuum action is applied to the board for approximately a 2–5 second dwell period and is at a vacuum of at least 10–20 inches of mercury.

3. In a process for producing a fiberboard structure by a water laid process characterized in that the fiberboard has two parrallel surfaces, the steps of forming the fiberboard comprising:

a. forming an aqueous slurry of at least one fibrous material, b. felting a fibrous board of the slurry on a conventional water laid forming machine, c. partially dewatering the fibrous board by drainage and/or a first vacuum action to form a sheet of approximately 1.5 inches thickness, d. consolidating the board by a pressure operation to further dewater the product and to reduce its thickness about one half and decrease its porosity due to a 40 to 120% densification, e. the improvement comprising then further subjecting the fibrous board to a high level vacuum action after the consolidation step to further dewater the board to reduce the water load of the board approximately 1/5–¼ of the initial water load, said high level vacuum action being greater than the vacuum action of the above-said first vacuum action and this further high level vacuum action dewatering the board after it has been consolidated to its final size, said last-mentioned vacuum action is applied to the board for approximately a 2–5 second dwell period and is at a vacuum of at least 10–20 inches of mercury.

* * * * *